US009167348B1

(12) United States Patent
Vartanian

(10) Patent No.: US 9,167,348 B1
(45) Date of Patent: Oct. 20, 2015

(54) WIRELESS WATERPROOF HEADPHONE SYSTEM

(71) Applicant: shenYon, Inc., Fresno, CA (US)

(72) Inventor: Nancy Vartanian, Beverly Hills, CA (US)

(73) Assignee: shenYon, Inc., Fresno, CA (US)

( * ) Notice: Subject to any disclaimer, the term of this patent is extended or adjusted under 35 U.S.C. 154(b) by 327 days.

(21) Appl. No.: 13/791,533

(22) Filed: Mar. 8, 2013

Related U.S. Application Data

(60) Provisional application No. 61/608,566, filed on Mar. 8, 2012.

(51) Int. Cl.
*H04R 5/033* (2006.01)

(52) U.S. Cl.
CPC ..... *H04R 5/033* (2013.01)

(58) Field of Classification Search
CPC .. H04R 5/033; H04R 1/1016; H04R 2420/07; H04R 2225/55
USPC ..... 381/311, 309
See application file for complete search history.

(56) References Cited

U.S. PATENT DOCUMENTS

| | | | | |
|---|---|---|---|---|
| 4,158,753 | A | 6/1979 | Gorike | |
| 5,048,090 | A | 9/1991 | Geers | |
| 5,276,740 | A | 1/1994 | Inanaga et al. | |
| 5,771,441 | A | 6/1998 | Altstatt | |
| 6,505,076 | B1 | 1/2003 | Tziviskos et al. | |
| 6,671,494 | B1 | 12/2003 | James | |
| 6,738,487 | B1 | 5/2004 | Nageno et al. | |
| 7,555,134 | B2 | 6/2009 | Dunn et al. | |
| 7,627,352 | B2 | 12/2009 | Gauger, Jr. et al. | |
| 7,778,443 | B2 | 8/2010 | Watanabe et al. | |
| 7,877,121 | B2 | 1/2011 | Seshadri et al. | |
| 7,891,360 | B2 | 2/2011 | Buck et al. | |
| 8,005,252 | B2 | 8/2011 | Connors et al. | |
| 8,041,066 | B2 | 10/2011 | Solum | |
| 8,059,845 | B2 | 11/2011 | Bryant | |
| 8,180,078 | B2 * | 5/2012 | Zellner | 381/311 |
| 8,891,800 | B1 * | 11/2014 | Shaffer | 381/384 |
| 2007/0149261 | A1 * | 6/2007 | Huddart | 455/575.2 |
| 2008/0310666 | A1 * | 12/2008 | Wengreen | 381/381 |
| 2009/0010461 | A1 * | 1/2009 | Klinghult et al. | 381/309 |
| 2012/0155689 | A1 * | 6/2012 | Milodzikowski et al. | 381/379 |
| 2014/0376735 | A1 * | 12/2014 | Asrani et al. | 381/74 |

* cited by examiner

*Primary Examiner* — Angel Castro

(74) *Attorney, Agent, or Firm* — Aka Chan LLP

(57) ABSTRACT

A wireless dual-functioning headset, which is waterproof and allows a user to make and receive phone calls through voice recognition as well as listen to music on a smartphone. It all can be customized by setting the preferences on a mobile software application. An implementation is an earbud headphone system that is both wireless and waterproof running off of RF waves that has the ability to sync with music on a smartphone.

6 Claims, 4 Drawing Sheets

WIRELESS WATERPROOF HEADPHONE SYSTEM

CROSS-REFERENCE TO RELATED APPLICATIONS

This patent application claims the benefit of U.S. patent application 61/608,566, filed Mar. 8, 2012, which is incorporated by reference.

BACKGROUND OF THE INVENTION

This invention relates to a wireless dual-functioning headset, which is waterproof and allows a user to make and receive phone calls through voice recognition as well as listen to music on a smartphone. It all can be customized by setting the preferences on a mobile software application.

Many people carry smartphones and other phones and mobile electronic devices daily. Smartphones and electronic devices are useful for many tasks including making calls, having video conferences, watching videos, listening to music or audio books, and other multimedia uses. Often people use headphones with smartphones to avoid disturbing others and when the conditions are somewhat noisy.

It is desirable to be able to use headphones, such as earbuds, in a greater number of environments and situations including wet and wet weather situations. A typical headphone can become damaged if they become wet or moist, ruining the delicate electronics. The headphone may cease to work entirely or be permanently damaged such as having reduced capabilities (e.g., reduced frequency range or garbled microphone reception). Therefore, it is desirable to use headphones in wet or damp conditions such as while swimming, surfing, diving, snorkeling, relaxing by the pool, at the spa, showering, walking or cycling in the rain, and many other similar activities.

Therefore, there is a need for an improved headphone system.

BRIEF SUMMARY OF THE INVENTION

A wireless dual-functioning headset, which is waterproof and allows a user to make and receive phone calls through voice recognition as well as listen to music on a smartphone. It all can be customized by setting the preferences on a mobile software application. An implementation is an earbud headphone system that is both wireless and waterproof running off of RF waves that has the ability to sync with music on a smartphone.

Some features of an earbud headphone system include: dual-functioning feature of making/receiving phone calls and listing to music at the same time, complete customization of each earbud unit, waterproofing, and most importantly our wireless component.

The wireless connectivity is based off of radio frequency (RF) waves, by adding a small component to the main unit's audio jack. Waterproofing feature to be able to listen to music under water (e.g., swimming, diving, or snorkeling) or make phone calls in the shower. A dual-functioning feature allows making and receiving phone calls as well as syncing the user's music. And a software application that allows the user to completely customize each unit based on the user's preferred settings. This software application can execute on a smartphone such as Apple's iPhone or an Android phone.

In an implementation, the headphones are known as EnJai™ earbuds from shenYon, Inc. A mobile application for Android is know as the EnJai mobile application.

In an implementation, a system includes: a first earbud headphone of a stereo earbud set, where the first earbud includes a first wireless transceiver and the first earbud is waterproof; a second earbud headphone of the stereo earbud set, where the second earbud includes a second wireless transceiver, the second earbud is waterproof, and the first earbud is not connected to the second earbud with a wire (or other physical connection); a third wireless transceiver connected to a 3.5-millimeter stereo headphone connector, which is adapted to be inserted into and mate with a 3.5-millimeter stereo headphone jack of a smartphone (e.g., Apple iPhone or Android smartphone), The system can further include a software application program (e.g., which may be referred to as an "app"), including code executable on a processor (e.g., ARM processor) of the smartphone, where the software application program includes: code to cause audio input and output of the smartphone to pass through the 3.5-millimeter stereo headphone jack through the third wireless transceiver and wirelessly transmit (bidirectional) to the first and second earbuds; code to generate a first touch interactive screen to allow a user to specify music volume levels for the first and second earbuds independently of each other; code to generate a second touch interactive screen to allow a user to specify phone call volume levels for the first and second earbuds independently of each other; code to generate a third touch interactive screen to allow a user to specify to receive phones calls on either the first earbud or the second earbud only; code to generate a fourth touch interactive screen to allow a user to specify to put the first and second earbuds into a sleep mode; and code to generate a fifth screen that indicates a battery charge level of the first ear bud and a battery charge level of the second earbud separately.

At least one of the first or the second earbuds includes a microphone. The first and second earbuds, while inserted into a user's ears, can play music while under water up to about 4 meters deep.

In a specific implementation, the first, second, and third wireless transceivers operate in a 2.4 gigahertz frequency range. Other frequencies can be used in other implementations.

The first earbud includes a push button, which when pushed down allows a user to answer incoming phone calls. The second earbud can also include such a push button.

The first earbud includes a knob, which when turned allows a user to control a volume of sound being played through the first earbud. The second earbud can also include such a knob.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
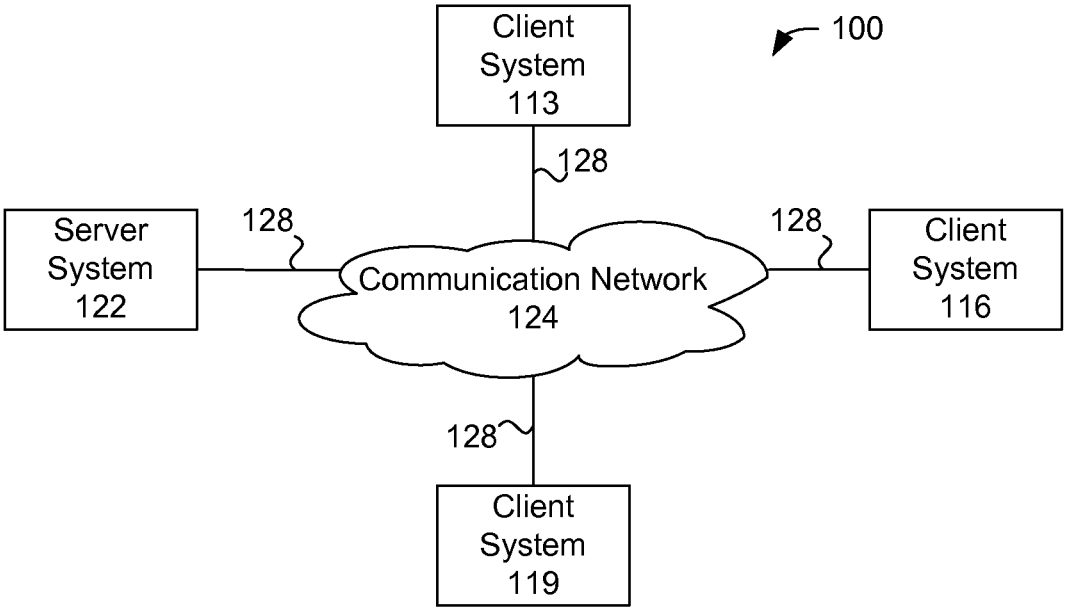
FIG. 1 shows a simplified block diagram of a system including a wireless and waterproof headphone system implemented in a distributed computing network connecting a server and clients.

FIG. 1 is a simplified block diagram of a distributed computer network 100 incorporating an embodiment of the present invention. Computer network 100 includes a number of client systems 113, 116, and 119, and a server system 122 coupled to a communication network 124 via a plurality of communication links 128. Communication network 124 provides a mechanism for allowing the various components of distributed network 100 to communicate and exchange information with each other.

Communication network 124 may itself be comprised of many interconnected computer systems and communication links. Communication links 128 may be hardwire links, optical links, satellite or other wireless communications links, wave propagation links, or any other mechanisms for communication of information. Various communication protocols may be used to facilitate communication between the various systems shown in FIG. 1. These communication protocols may include TCP/IP, HTTP protocols, wireless application protocol (WAP), vendor-specific protocols, customized protocols, and others. While in one embodiment, communication network 124 is the Internet, in other embodiments, communication network 124 may be any suitable communication network including a local area network (LAN), a wide area network (WAN), a wireless network, a intranet, a private network, a public network, a switched network, and combinations of these, and the like.

Distributed computer network 100 in FIG. 1 is merely illustrative of an embodiment incorporating the present invention and does not limit the scope of the invention as recited in the claims. One of ordinary skill in the art would recognize other variations, modifications, and alternatives. For example, more than one server system 122 may be connected to communication network 124. As another example, a number of client systems 113, 116, and 119 may be coupled to communication network 124 via an access provider (not shown) or via some other server system.

Client systems 113, 116, and 119 typically request information from a server system which provides the information. For this reason, server systems typically have more computing and storage capacity than client systems. However, a particular computer system may act as both as a client or a server depending on whether the computer system is requesting or providing information. Additionally, although aspects of the invention has been described using a client-server environment, it should be apparent that the invention may also be embodied in a stand-alone computer system.

Server 122 is responsible for receiving information requests from client systems 113, 116, and 119, performing processing required to satisfy the requests, and for forwarding the results corresponding to the requests back to the requesting client system. The processing required to satisfy the request may be performed by server system 122 or may alternatively be delegated to other servers connected to communication network 124.

According to the teachings of the present invention, client systems 113, 116, and 119 enable users to access and query information stored by server system 122. In a specific embodiment, a "web browser" application executing on a client system enables users to select, access, retrieve, or query information stored by server system 122. Examples of web browsers include the Internet Explorer browser program provided by Microsoft Corporation, and the Firefox browser provided by Mozilla, and others.

Figure 2:
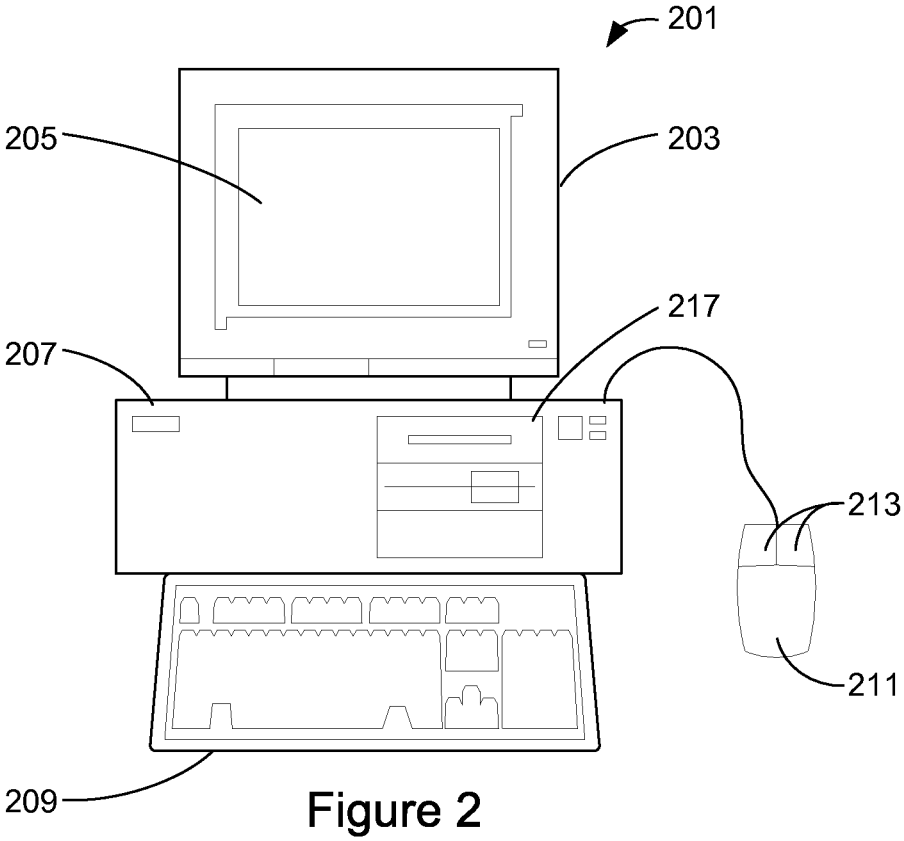
FIG. 2 shows a more detailed diagram of an exemplary client of the system.

FIG. 2 shows an exemplary client system of the present invention. In an embodiment, a user interfaces with the system through a computer workstation system, such as shown in FIG. 2. FIG. 2 shows a computer system 201 that includes a monitor 203, screen 205, enclosure 207 (may also be referred to as a system unit, cabinet, or case), keyboard or other human input device 209, and mouse or other pointing device 211. Mouse 211 may have one or more buttons such as mouse buttons 213.

Enclosure 207 houses familiar computer components, some of which are not shown, such as a processor, memory, mass storage devices 217, and the like. Mass storage devices 217 may include mass disk drives, floppy disks, magnetic disks, optical disks, magneto-optical disks, fixed disks, hard disks, CD-ROMs, recordable CDs, DVDs, recordable DVDs (e.g., DVD-R, DVD+R, DVD-RW, DVD+RW, HD-DVD, or Blu-ray Disc), flash and other nonvolatile solid-state storage (e.g., USB flash drive), battery-backed-up volatile memory, tape storage, reader, and other similar media, and combinations of these.

A computer-implemented or computer-executable version or computer program product of the invention may be embodied using, stored on, or associated with computer-readable medium. A computer-readable medium may include any medium that participates in providing instructions to one or more processors for execution. Such a medium may take many forms including, but not limited to, nonvolatile, volatile, and transmission media. Nonvolatile media includes, for example, flash memory, or optical or magnetic disks. Volatile media includes static or dynamic memory, such as cache memory or RAM. Transmission media includes coaxial cables, copper wire, fiber optic lines, and wires arranged in a bus. Transmission media can also take the form of electromagnetic, radio frequency, acoustic, or light waves, such as those generated during radio wave and infrared data communications.

For example, a binary, machine-executable version, of the software of the present invention may be stored or reside in RAM or cache memory, or on mass storage device 217. The source code of the software of the present invention may also be stored or reside on mass storage device 217 (e.g., hard disk, magnetic disk, tape, or CD-ROM). As a further example, code of the invention may be transmitted via wires, radio waves, or through a network such as the Internet.

Figure 3:
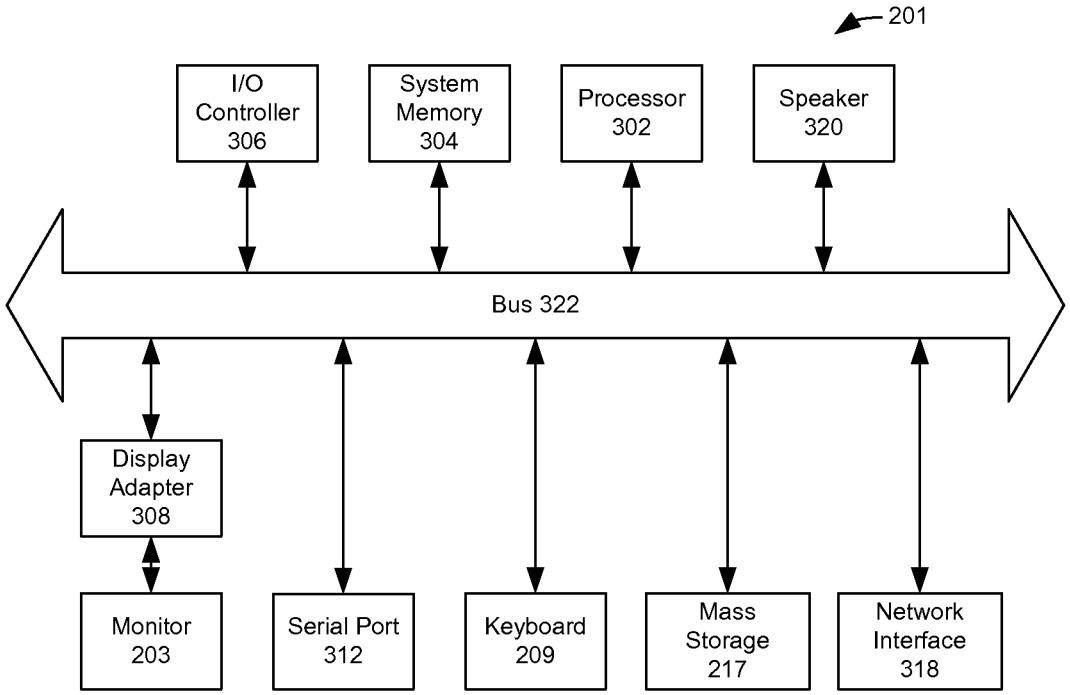
FIG. 3 shows a system block diagram of a client computer system used to execute application programs such as a web browser for the system.
Figure 4:
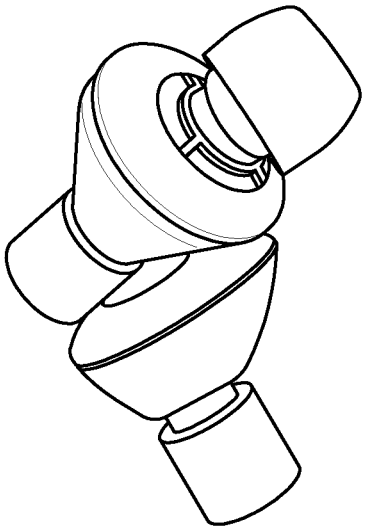
FIG. 4 shows a pair of earbuds.

FIG. 3 shows a system block diagram of computer system 201 used to execute the software of the present invention. As in FIG. 2, computer system 201 includes monitor 203, keyboard 209, and mass storage devices 217. Computer system 501 further includes subsystems such as central processor 302, system memory 304, input/output (I/O) controller 306, display adapter 308, serial or universal serial bus (USB) port 312, network interface 318, and speaker 320. The invention may also be used with computer systems with additional or fewer subsystems. For example, a computer system could include more than one processor 302 (i.e., a multiprocessor system) or a system may include a cache memory.

Arrows such as 322 represent the system bus architecture of computer system 201. However, these arrows are illustrative of any interconnection scheme serving to link the subsystems. For example, speaker 320 could be connected to the other subsystems through a port or have an internal direct connection to central processor 302. The processor may include multiple processors or a multicore processor, which may permit parallel processing of information. Computer system 201 shown in FIG. 2 is but an example of a computer system suitable for use with the present invention. Other configurations of subsystems suitable for use with the present invention will be readily apparent to one of ordinary skill in the art.

Computer software products may be written in any of various suitable programming languages, such as C, C++, C#, Pascal, Fortran, Perl, Matlab (from MathWorks, www.mathworks.com), SAS, SPSS, JavaScript, AJAX, and Java. The computer software product may be an independent application with data input and data display modules. Alternatively, the computer software products may be classes that may be instantiated as distributed objects. The computer software products may also be component software such as Java Beans (from Sun Microsystems) or Enterprise Java Beans (EJB from Sun Microsystems).

An operating system for the system may be one of the Microsoft Windows® family of operating systems (e.g., Windows 95, 98, Me, Windows NT, Windows 2000, Windows XP, Windows XP x64 Edition, Windows Vista, Windows 7, Windows, 8, Windows CE, Windows Mobile), Linux, HP-UX, UNIX, Sun OS, Solaris, Mac OS X, Apple iOS, Google Android, Alpha OS, AIX, IRIX32, or IRIX64. Other operating systems may be used. Microsoft Windows is a trademark of Microsoft Corporation.

Furthermore, the computer may be connected to a network and may interface to other computers using this network. The network may be an intranet, internet, or the Internet, among others. The network may be a wired network (e.g., using copper), telephone network, packet network, an optical network (e.g., using optical fiber), or a wireless network, or any combination of these. For example, data and other information may be passed between the computer and components (or steps) of a system of the invention using a wireless network using a protocol such as Wi-Fi (IEEE standards 802.11, 802.11a, 802.11b, 802.11e, 802.11g, 802.11i, 802.11n, and 802.1 lac, just to name a few examples), near field communication (NFC), radio-frequency identification (RFID), mobile or cellular wireless (e.g., 2G, 3G, 4G, 3GPP LTE, WiMAX, LTE, Flash-OFDM, HIPERMAN, iBurst, EDGE Evolution, UMTS, UMTS-TDD, 1xRDD, and EV-DO). For example, signals from a computer may be transferred, at least in part, wirelessly to components or other computers.

In an embodiment, with a web browser executing on a computer workstation system, a user accesses a system on the World Wide Web (WWW) through a network such as the Internet. The web browser is used to download web pages or other content in various formats including HTML, XML, text, PDF, and postscript, and may be used to upload information to other parts of the system. The web browser may use uniform resource identifiers (URLs) to identify resources on the web and hypertext transfer protocol (HTTP) in transferring files on the web.

There has not been an earbud headphone system designed to be both wireless and waterproof running off of radio frequency (RF) waves that has the ability to sync with music on a smartphone. This is the first product of its kind incorporating all those features.

Some problems with current headsets and headphones include: The issue being wires, and cords with no waterproof feature. There are no wireless stereo earbuds, where both earbuds do not have a wire connecting the two. In addition to that an implementation is waterproof and has a dual-functioning feature. A goal is to lessen the frustration users tend to have with headsets, headphones, and Bluetooth devices because of the cords, connectivity, and wires that restrict them from their daily active lifestyles. With EnJai earbuds, consumers have the freedom to completely customize each earbud unit to their liking. As far as features are concerned and they will have the comfort in knowing that our product is wireless, stereo, waterproof, and compact.

The hardware and software including in the Enjai product allows consumers to break the restriction they have with their current headphones, Bluetooth headsets, and other headsets. Features include: connectivity-with a 50 meter or greater distance away from the handheld device. EnJai earbuds connect through radio frequency (RF) waves (e.g., 2.4 gigahertz frequency range) which connect via the transceiver, will allow for example athletes to train from a distance, such as swimmers in an Olympic-sized pool. Wireless-feature gives the benefit of multitasking with free hands. Waterproof feature gives the user the opportunity to swim while listening to music under water up to about 4 meters deep. In addition, a user can take an important call while in the shower. With EnJai earbuds, the user never has to put someone on hold.

Voice recognition feature. There's an added bonus to being wireless, this feature gives the benefit of dialing by voice recognition by simply holding the top of the Earbud and giving a name in the directory or dial by number. Voice recognition will also play music according to user settings: playlists, artists, or albums.

Music feature. The software that is offered with EnJai allows the user to sync music and gives the user the ability to play songs in one particular earbud or both (depending on the user's setting preferences). That way the user can answer a call on one earbud, but still hear music on the other. It is completely customizable to the user's liking.

Phone function features. Making and receiving phone calls. The top of the earbuds when pushed down will allow the user to conveniently answer incoming calls as well as end calls.

Volume control features. Controlling the volume settings are easy with EnJai earbuds just turn the knob at the top of the earbud left or towards the back of the head (counter clockwise) to lower volume or right towards the front of the head (clockwise) to increase volume. Because of the advantages of our dual-functioning feature, the user can choose a different setting for each earbud.

The user may also set volume preferences in the EnJai mobile software application. As an example, say the user is listing to music while working and has an incoming call. Depending on the settings and preferences (which the earbud receives calls) the user can answer the call say on the user's left earbud while simultaneously lower the volume of the music playing on the right earbud.

Figure 5:
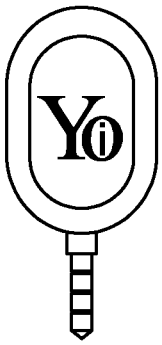
FIG. 5 shows a wireless transmitter having specifications: size 1.37×0.95×0.30 inches; weight 0.23 ounces; broadcast frequency: 2.4 gigahertz.
Figure 6:
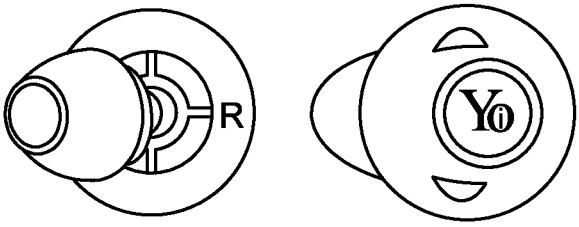
FIG. 6 shows a pair of earbuds with green-colored collar.
Figure 7:
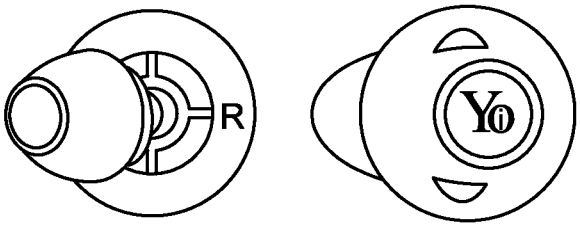
FIG. 7 shows a pair of earbuds, with silver-colored collar.

Battery life features. Because of the small RF transceiver unit (see FIG. 5 for an example) which can be attached to a headphone jack while in use. The design allows space saving for the earbuds, which in return generates an extended battery life up to 2-4 hours life span during use. The EnJai earbuds can have about 5 hours or more of standby battery life.

Figure 8:
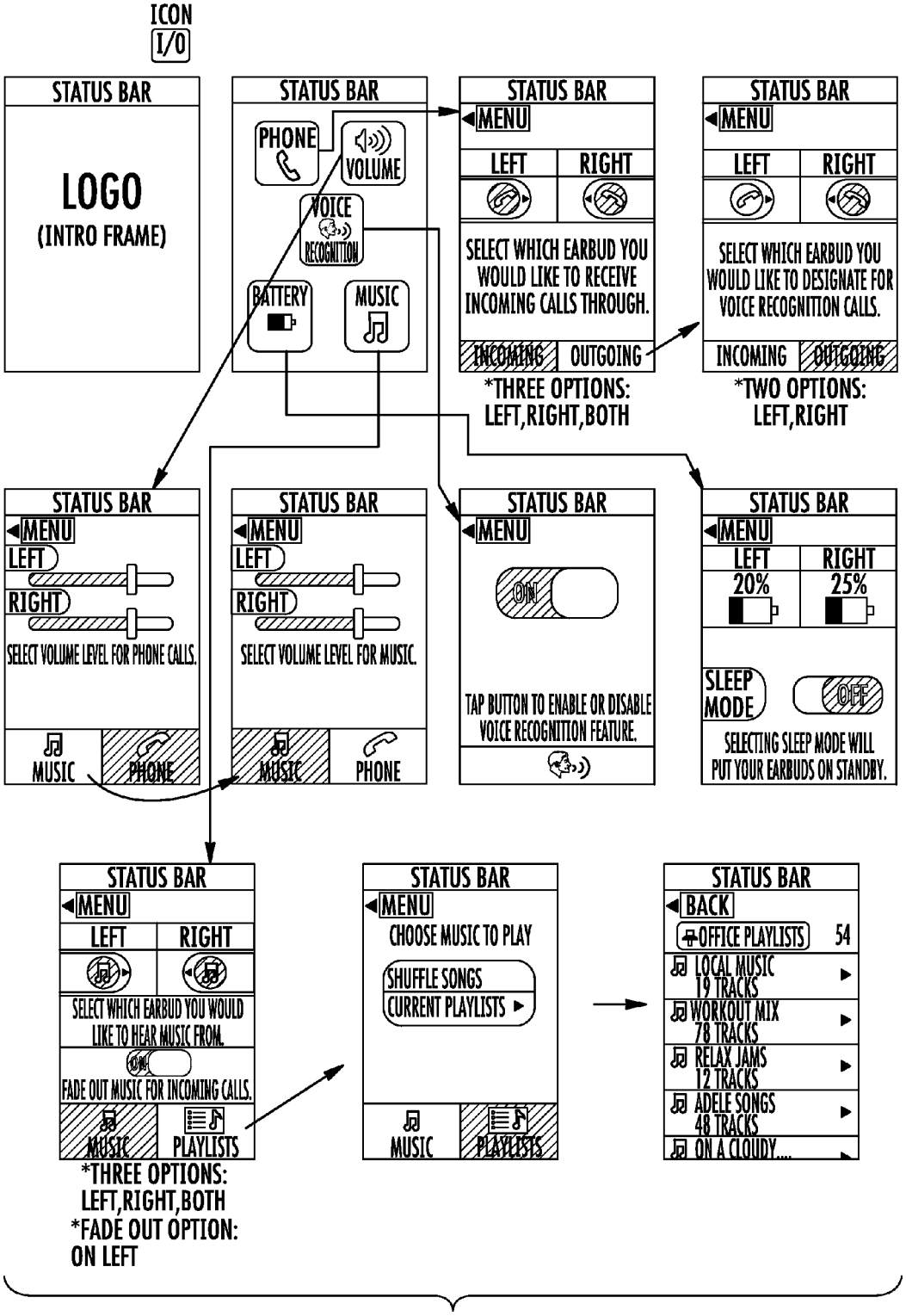
FIG. 8 shows a storyboard of a mobile application for use with a wireless and waterproof headphone system.

EnJai mobile application. The EnJai app that can be downloaded for a smartphone (e.g., iPhone or Android) gives the user all the functionality and ability to customize the earbuds based on user preference. Controlling music, phone calls, and volume all down to each individual earbud. FIG. 8 shows a storyboard of the mobile application.

Some feature of the mobile application include: a directional implementation that allows complete customization of left/right (units).

1. Phone calls, incoming and outgoing. Phone icon in the application to indicate a call.

1 a. Option to choose which earbud (incoming calls) comes in on (left/right/both).

1b. Option to choose which earbud (outgoing calls) are placed from (left/right).

1 c. Incoming: These choices will dictate how "when" music is playing and an incoming call is coming through which earbud will "fade out" the music to accept the phone call (all, or which earbud will ring letting the user know a call is coming through). Three options: left, right, or both.

1d. Outgoing: which ever earbud is chosen to be designated to do "outgoing" calls will be the one users hold down to start "voice recognition." Dialing by: name or number; two options include left or right.

In an implementation, the earbuds can be used on independent calls, such as the left earbud for one call and the right earbud for another call. This feature can be used in situations like a phone's flash operation (e.g., to put a person on hold on one earbud, and start another call on the other earbud). This feature can be used when joining people in a conference call. People on a conference call will be together one earbud, while a new person being added will be the other earbud. After the person is added, the conference call can take place on one earbud or both earbuds, at the option of the user.

2. Voice recognition. Face icon with sound waves by mouth. Option enable/disable features: on/off. This feature allows user to dial by name in phone directory, or number.

3. Volume control. Sound icon. Option to simply touch volume bar on each unit customization.

3a. Specific volume levels for each unit: touch level of volume for each unit.

3b. Can customize it in two ways: different volume options for phone calls (outgoing/incoming) and music playing. Simply tap button to switch from settings (music/phone)

3c. Tracking Option to enable or disable tracking/location feature (on/off).

4. Music. Playlists are supported. Can be synchronized to other music applications or libraries. There is a music icon.

4a. With music tab/button the user can choose playlists, shuffle current songs on the phone or choose specific songs.

4b. Also under this category the user can customize which earbud plays the music.

4c. Three options: left, right, both.

4d. Music fade out option: on/off button.

5. Battery life/sleep mode. There is a battery icon.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A system comprising:

a first earbud headphone of a stereo earbud set, wherein the first earbud comprises a first wireless transceiver and the first earbud is waterproof;

a second earbud headphone of the stereo earbud set, wherein the second earbud comprises a second wireless transceiver, the second earbud is waterproof, and the first earbud is not coupled to the second earbud with a wire;

a third wireless transceiver coupled to a 3.5-millimeter stereo headphone connector, which is adapted to be coupled to a 3.5-millimeter stereo headphone jack of a smartphone;

a software application program, comprising code executable on a processor of the smartphone, wherein the software application program comprises:

code to cause audio input and output of the smartphone to pass through the 3.5-millimeter stereo headphone jack through the third wireless transceiver and wirelessly to the first and second earbuds;

code to generate a first touch interactive screen to allow a user to specify music volume levels for the first and second earbuds independently of each other;

code to generate a second touch interactive screen to allow a user to specify phone call volume levels for the first and second earbuds independently of each other;

code to generate a third touch interactive screen to allow a user to specify to receive phones calls on either the first earbud or the second earbud only;

code to generate a fourth touch interactive screen to allow a user to specify to put the first and second earbuds into a sleep mode; and code to generate a fifth screen that indicates a battery charge level of the first ear bud and a battery charge level of the second earbud separately.

2. The system of claim 1 wherein at least one of the first or the second earbuds comprises a microphone.

3. The system of claim 1 wherein the first and second earbuds can play music while under water up to about 4 meters deep.

4. The system of claim 1 wherein the first, second, and third wireless transceivers operate in a 2.4 gigahertz frequency range.

5. The system of claim 1 wherein the first earbud comprises a push button, which when pushed down allows a user to answer incoming phone calls.

6. The system of claim 1 wherein the first earbud comprises a knob, which when turned allows a user to control a volume of sound being played through the first earbud.

* * * * *